US010910769B2

(12) United States Patent
Yoshida et al.

(10) Patent No.: US 10,910,769 B2
(45) Date of Patent: Feb. 2, 2021

(54) CONNECTOR STRUCTURE WITH MULTIPLE DISENGAGEMENT MECHANISMS

(71) Applicants: YAZAKI CORPORATION, Tokyo (JP); TOYOTA JIDOSHA KABUSHIKI KAISHA, Toyota (JP)

(72) Inventors: Takato Yoshida, Makinohara (JP); Hiroshi Kobayashi, Okazaki (JP)

(73) Assignees: YAZAKI CORPORATION, Tokyo (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/521,769

(22) Filed: Jul. 25, 2019

(65) Prior Publication Data

US 2020/0076128 A1 Mar. 5, 2020

(30) Foreign Application Priority Data

Aug. 28, 2018 (JP) ..... 2018-158821

(51) Int. Cl.

| | |
|---|---|
| ***H01R 13/627*** | (2006.01) |
| ***H01R 13/633*** | (2006.01) |
| ***H01R 13/15*** | (2006.01) |
| ***H01R 13/502*** | (2006.01) |
| *H01R 43/26* | (2006.01) |
| *H01R 13/639* | (2006.01) |

(52) U.S. Cl.

CPC ..... *H01R 13/633* (2013.01); *H01R 13/15* (2013.01); *H01R 13/502* (2013.01); *H01R 13/6272* (2013.01); *H01R 13/6273* (2013.01); *H01R 13/639* (2013.01); *H01R 43/26* (2013.01)

(58) Field of Classification Search

CPC ... H01R 13/639; H01R 13/6273; H01R 43/26

See application file for complete search history.

(56) References Cited

U.S. PATENT DOCUMENTS 5,342,215 A * 8/1994 Silbernagel ..... H01R 13/6273 439/357
7,416,425 B2 * 8/2008 Murakami ..... H01R 13/6295 439/157

(Continued)

FOREIGN PATENT DOCUMENTS

JP 2003-317866 A 11/2003
JP 2006-286462 A 10/2006

(Continued)

*Primary Examiner* — Tho D Ta

(74) *Attorney, Agent, or Firm* — Sughrue Mion, PLLC

(57) ABSTRACT

A connector structure (3) includes a first connector (1) and a second connector (2). The outer housing (10) of the first connector (1) has: a lock mechanism (12) to be engaged with a counterpart housing (60) of the second connector (2) to restrict a rearward movement of the counterpart housing (60) in the fitting direction when fitting the first connector (1) and the second connector (2); a first unlocking mechanism (14) configured to disengage a lock mechanism (12) for the counterpart housing (60); and a second unlocking mechanism (18) located at a different position than the first unlocking mechanism (14) and configured to disengage the lock mechanism (12) independently of the first unlocking mechanism (14).

4 Claims, 9 Drawing Sheets

(56) References Cited

U.S. PATENT DOCUMENTS

| | | | | |
|---|---|---|---|---|
| 7,488,190 | B2 * | 2/2009 | Takahashi | H01R 13/62955 439/157 |
| 8,235,744 | B1 * | 8/2012 | Liptak | H01R 13/639 439/352 |
| 2006/0240716 | A1 | 10/2006 | Kozono et al. | |
| 2007/0190833 | A1 | 8/2007 | Takahashi et al. | |

FOREIGN PATENT DOCUMENTS

| | | | |
|---|---|---|---|
| JP | 2007-220314 | A | 8/2007 |
| JP | 2009-230898 | A | 10/2009 |
| JP | 2014-56700 | A | 3/2014 |

* cited by examiner

CONNECTOR STRUCTURE WITH MULTIPLE DISENGAGEMENT MECHANISMS

CROSS-REFERENCES TO RELATED APPLICATION(S)

This application is based on and claims priority from Japanese Patent Application No. 2018-158821 filed on Aug. 28, 2018, and the entire contents of which are incorporated herein by reference.

BACKGROUND

Field of the Invention

The present invention relates to a connector structure that is equipped with two connectors that can be fitted into or with each other.

Description of Related Art

Among known connector structures in which housings each equipped with terminals are fitted into or with each other are one that is equipped with lock mechanisms for engaging housings with each other so that they are kept fitted in or with each other and unlocking mechanisms capable of canceling the engagement made by the lock mechanisms.

In the above conventional connector structure, a spring that urges the housings in such directions as to cancel their fitting (i.e., to make them go away from each other) at the time of the fitting is provided between the housings. With this measure, when the engagement made by the lock mechanisms has been canceled, the housings are moved relative to each other automatically in such directions that their fitting is canceled, by urging force of the spring. In this manner, the housings can be separated from each other easily when the fitting of the connector structure is canceled.

As for details of the above connector structures, refer to JP 2009-230898 A.

SUMMARY

In the above conventional connector structure, canceling manipulation portions to be manipulated to cause the unlocking mechanisms to operate are provided on outside surfaces of the outside housing. However, where, for example, this connector structure is applied to a place where various members are arranged densely, there may occur a case that the canceling manipulation portions are covered with another member (e.g., wire harness). Although even in such a case it is possible to manipulate the canceling manipulation portions, the manipulation needs to be performed while getting around the other member. It is therefore difficult to increase the efficiency of work of canceling the engagement made by the lock mechanisms.

An object of the invention is to provide a connector structure that makes it possible to cancel a fitting state more reliably even in a case that another member exists around the connector structure.

Embodiments of the present invention provide the following items (1) and (2):

(1) A connector structure comprising a first connector and a second connector to be fitted each other, the first connector having: an outer housing; an inner housing supported by the outer housing to allow a displacement of the inner housing in a fitting direction; and an elastic member to urge the inner housing forward in the fitting direction the second connector having a counterpart housing to be attached to the outer housing, upon fitting the first connector and the second connector, while the elastic member generating a forward urging force in the fitting direction due to the displacement of the inner housing rearward in the fitting direction, and the outer housing having: a lock mechanism to be engaged with the counterpart housing to restrict a rearward movement of the counterpart housing in the fitting direction upon fitting the first connector and the second connector; a first unlocking mechanism configured to disengage the lock mechanism; and a second unlocking mechanism located at a different position than the first unlocking mechanism and configured to disengage the lock mechanism independently of the first unlocking mechanism.

(2) The connector structure according to claim 1, wherein the lock mechanism is a lock arm having a cantilevered-shape and an engagement portion to be engaged with a projection portion provided in the counterpart housing, the first unlocking mechanism has a manipulation portion provided as a part of the outer housing to be exposed to outside of the outer housing and configured to bend the lock arm in a direction to disengage the projection portion and the engagement portion, and the second unlocking mechanism has a penetration portion configured to allow a communication from outside of the outer housing to an engagement location of the projection portion and the engagement portion by inserting an unlocking tool through the penetration portion to move the engagement portion in a direction to disengage the projection portion and the engagement portion.

According to first aspect of the invention, relating to the item (1), in an example case that the connector structure is installed in a place where various members are arranged densely, even if it is difficult to manipulate the first unlocking mechanism easily, the engagement by the lock mechanism can be canceled by manipulating the second unlocking mechanism which is located at the different position than the first unlocking mechanism. Furthermore, when the engagement by the lock mechanism has been canceled, inner housing and the counterpart housing can be separated from each other easily by the urging force of the elastic member. This makes it possible to cancel the fitting state more reliably than in the conventional connector structure even in a case that another member exists around the connector structure.

According to second aspect of the invention, relating to the item (2), since the penetration portion is formed through the outer housing of the first connector as the second unlocking mechanism, the engagement between the projection portion of the counterpart housing and the lock arm (engagement portion) can be canceled by inserting the unlocking tool through the penetration portion. Thus, the second unlocking mechanism can be realized by a relatively simple structure in contrast to a case that the outer housing is provided with a second unlocking mechanism having a complex structure. The connector structure can therefore be miniaturized.

The invention can provide a connector structure that makes it possible to cancel a fitting state more reliably even in a case that another member exists around the connector structure.

Several aspects of the invention have been described briefly above. The further details of the invention will be made clearer if the following description is read through with reference to the accompanying drawings.

DETAILED DESCRIPTION

Embodiment

A connector structure 3 according to an embodiment of the present invention which is equipped with a female connector 1 and a male connector 2 which can be fitted into or with each other will be hereinafter described with reference to the drawings. In the following, for convenience of description, for each of the female connector 1 and the male connector 2, the front side in the fitting direction (i.e., the side closer to the counterpart connector) may be referred to as a front side and the side in the fitting direction (i.e., the opposite side to the counterpart connector) may be referred to as a rear side. For example, in FIG. 4 which shows the connector structure 3 in which the female connector 1 and the male connector 2 are fitted into or with each other, for the female connector 1, the left side and the right side are the front side and the rear side, respectively. For the male connector 2, the right side and the left side are the front side and the rear side, respectively. Furthermore, for each of the female connector 1 and the male connector 2, the top side and the bottom side are defined as those in FIG. 4.

Figure 1:
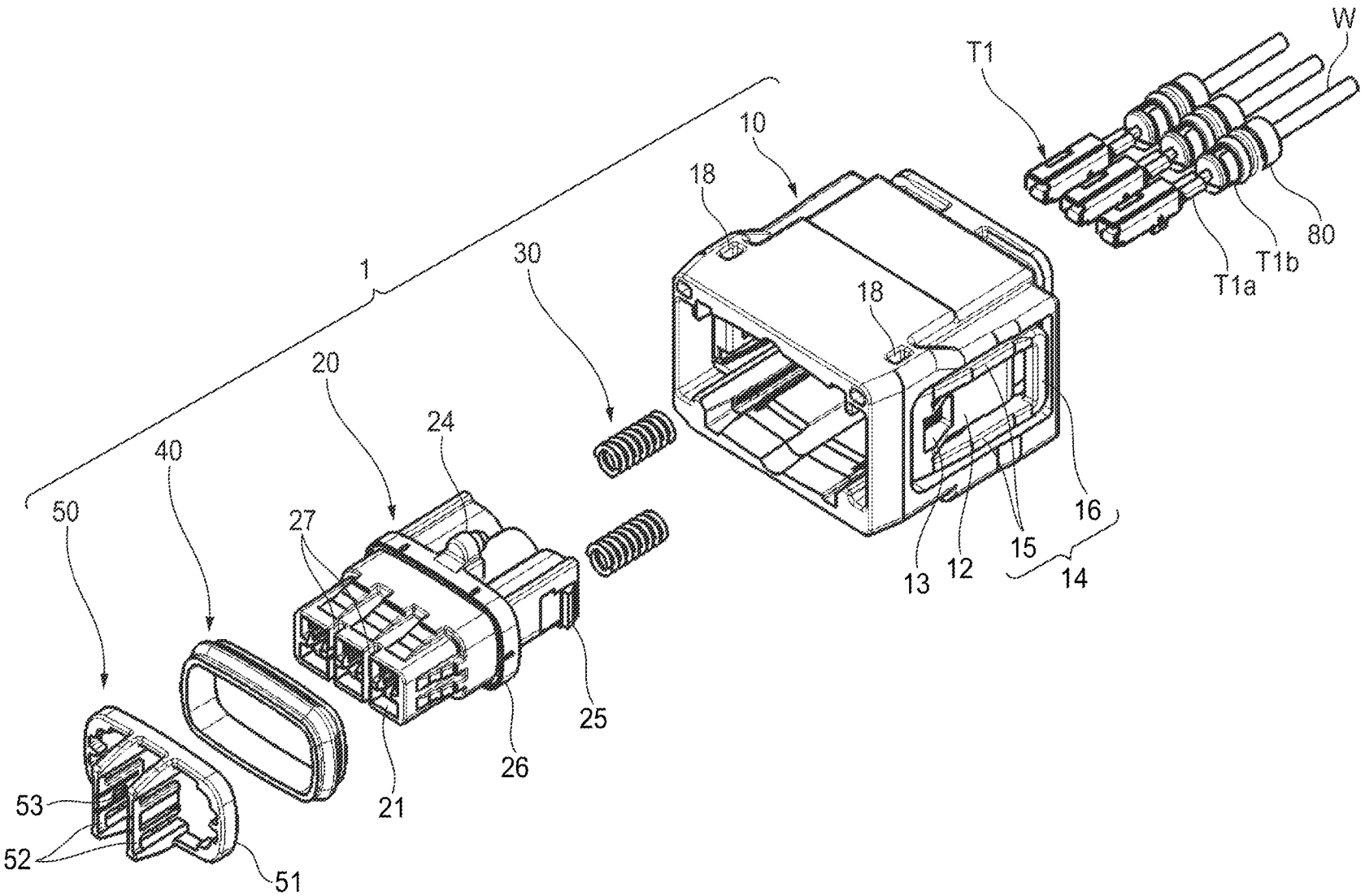
FIG. 1 is an exploded perspective view of a female connector of a connector structure according to an embodiment.

First, components that constitute the female connector 1 will be described with reference to FIGS. 1, 2, 3A and 3B. As shown in FIG. 1, the female connector 1 is equipped with an outer housing 10, an inner housing 20 which is housed in the outer housing 10 so as to be movable in the front-rear direction relative to the outer housing 10, elastic members 30 which are provided inside the outer housing 10 and urge the inner housing 20 forward, a packing 40 which is placed on the outer circumferential surface of the inner housing 20 and seals it watertightly, and a packing holder 50 for holding the packing 40 on the inner housing 20.

First, the outer housing 10 will be described. The outer housing 10 is made of a resin and is generally shaped like a rectangular cylinder having a through-hole extending in the front-rear direction. As shown in FIG. 3A which is a sectional view taken along line A-A in FIG. 2, rear end portions of a top wall and a bottom wall of the outer housing 10 are formed with, in a unitized manner, rear support portions 11 for supporting rear end portions of the elastic members 30 at the centers in the width direction, respectively, in such a manner that the rear support portions 11 are exposed to the internal space of the outer housing 10.

Figure 2:
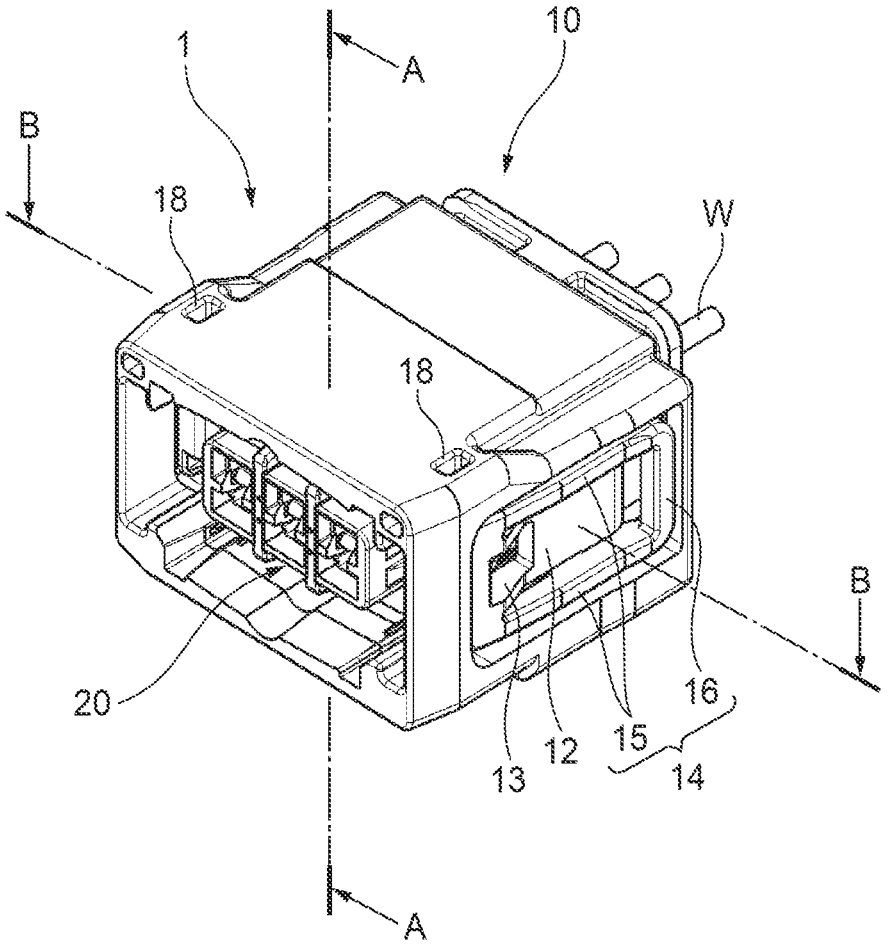
FIG. 2 is a perspective view of the female connector assembled.
Figure 3A:
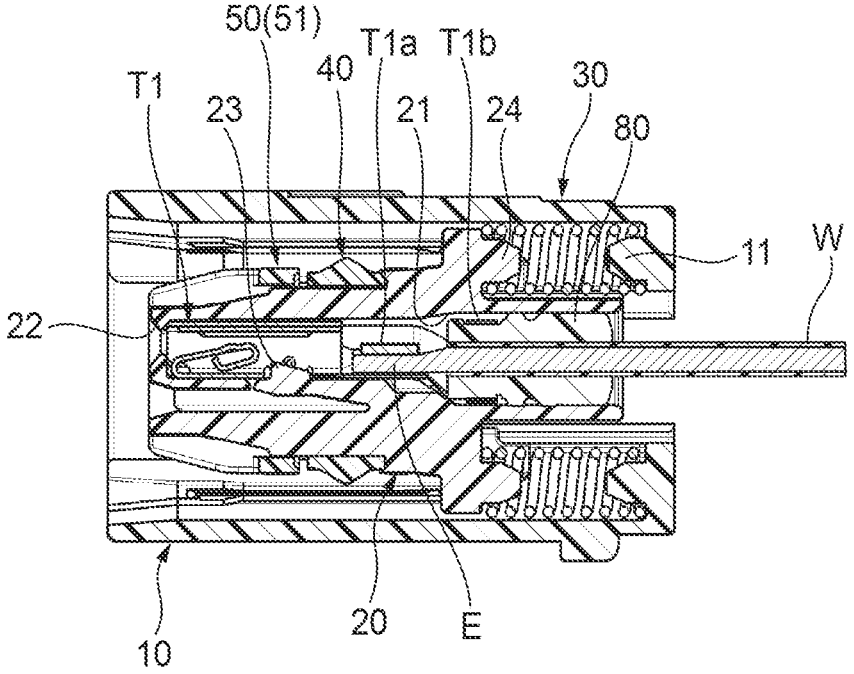
FIG. 3A is a sectional view taken along line A-A in FIG. 2.
Figure 3B:
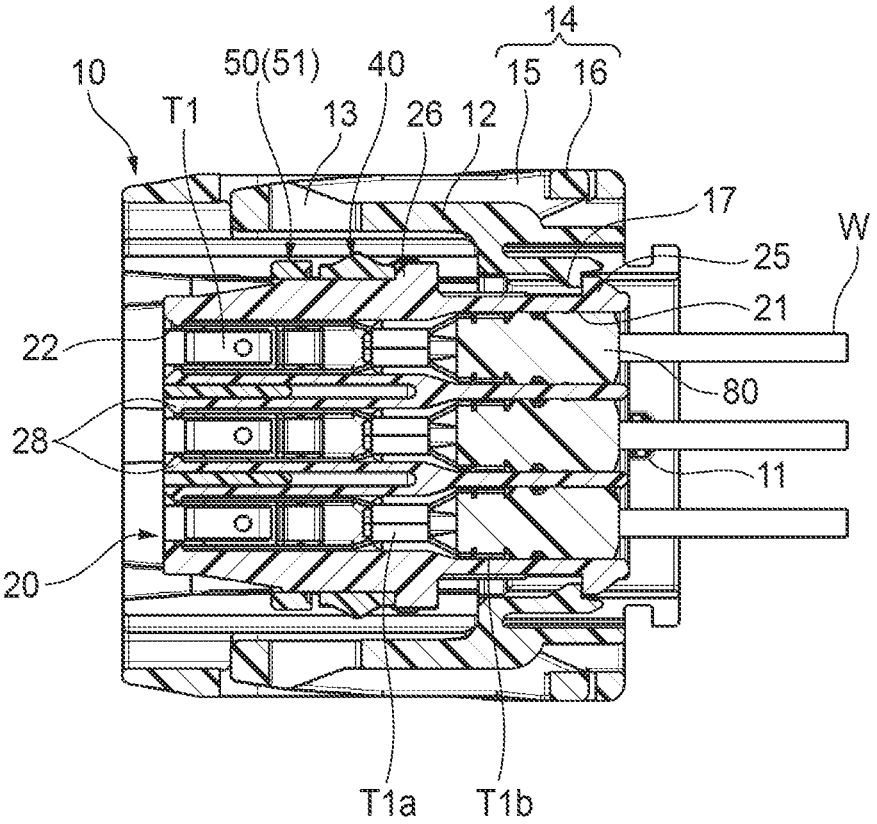
FIG. 3B is a sectional view taken along line B-B in FIG. 2.

As shown in FIG. 2 and FIG. 3B which is a sectional view taken along line B-B in FIG. 2, each of two side surfaces of the outer housing 10 is formed with a lock arm 12 and an unlocking arm 14 in such a manner that they are parts of (i.e., unitized with) the side wall.

Each lock arm 12 is a plate-like body extending forward like a cantilever from around a rear end portion of the side surface of the outer housing 10 and can deform elastically in the width direction. A lock hole 13 penetrates through a front end portion (free end portion) of each lock arm 12 in the width direction. As described later, the lock hole 13 has a function of keeping a fitting state of the inner housing 20 and a housing 60 of the male connector 2 (in other words, the female connector 1 and the male connector 2) by engaging with a lock beak 62 of the housing 60 (see FIGS. 59 and 5C).

Each lock arm 12 is provided with the unlocking arm 14 in a unitized manner. The unlocking arm 14 is composed of a pair of lever portions 15 which extend rearward like cantilevers from top and bottom end portions of a front end portion of the lock arm 12, respectively, and a link portion 16 (i.e., cancelling manipulation portion) which connects rear end portions (i.e., free end portions) of the pair of lever portions 15 and extends in the top-bottom direction. The lock arm 12 is deformed elastically outward in the width direction by pushing the link portion 16 inward in the width direction. As a result, the lock hole 13 which is formed in the front end portion of the lock arm 12 is moved outward in the width direction (i.e., moved in a disengaging direction) and the lock beak 62 is disengaged from the lock hole 13 (see FIGS. 6A-6C).

As shown in FIG. 3B, inner surfaces, in the width direction, of rear end portions (more specifically, end portions in the rear of the lock arms 12) of the two side walls of the outer housing 10 are formed with, in a unitized manner, a pair of lock pieces 17 which project inward in the width direction. As described later, the pair of lock pieces 17 have a function of restricting the range of forward movement of the inner housing 20 with respect to the outer housing 10 (see FIG. 3B) by engaging with a pair of lock projections 25 (see FIGS. 1 and 3B) of the inner housing 20. In the following, the position of the inner housing 20 shown in FIG. 3B will be referred to as an "initial position."

Figure 8:
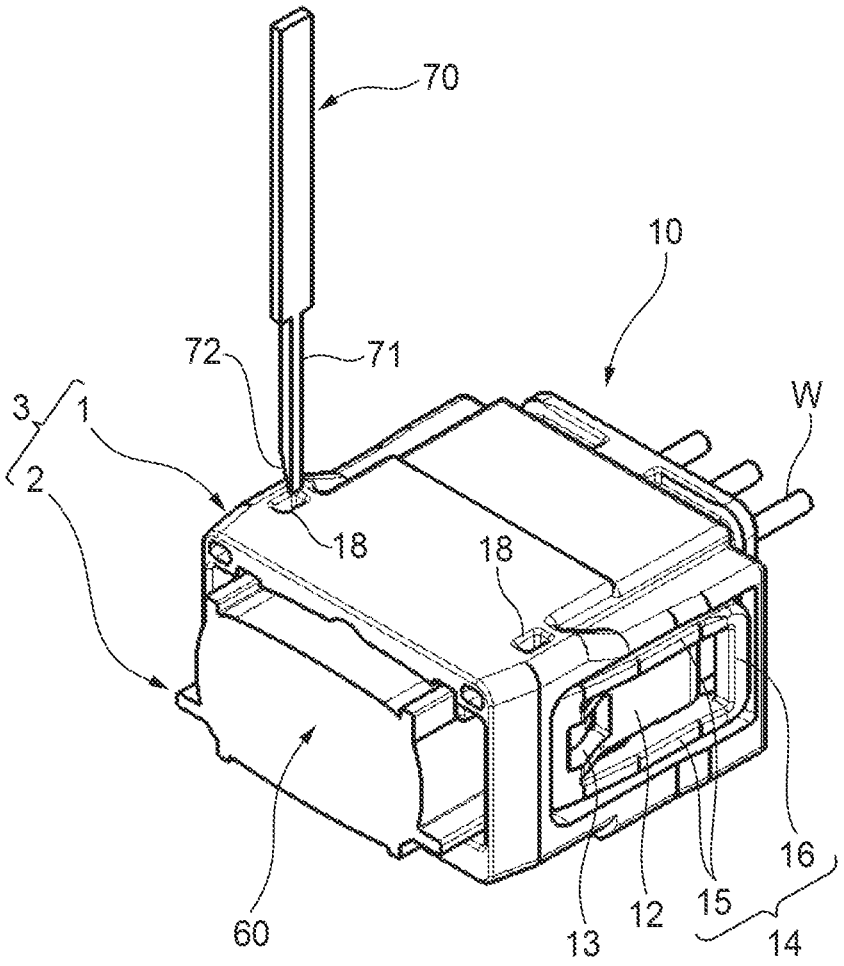
FIG. 8 is a perspective view of the connector structure showing how to perform unlocking by inserting an unlocking tool into a through-hole.
Figure 9:
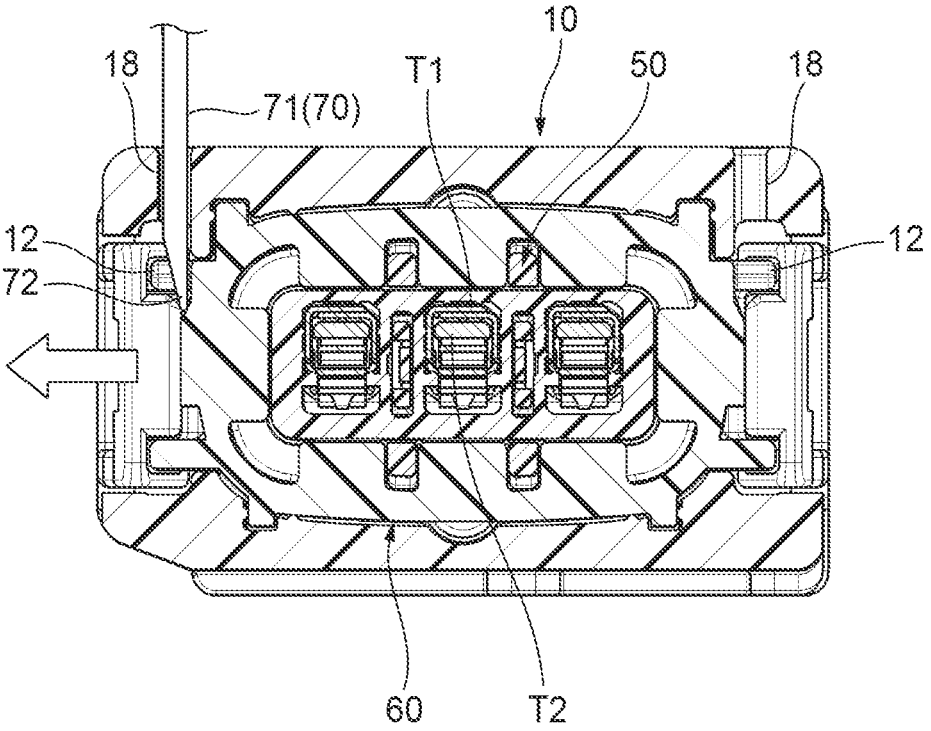
FIG. 9 is a sectional view showing how a lock arm is deformed elastically in a disengaging direction (outward in the width direction) by being pushed by the unlocking tool inserted through the through-hole.

As shown in FIGS. 1 and 2, a pair of penetration holes 18 penetrate through, in the top-bottom direction, two respective end portions, in the width direction, of a front portion of the top wall of the outer housing 10 (also see FIGS. 8 and 9). As described later, the penetration holes 18 are used to insert a cancelling tool 70 to perform unlocking in a case that it is difficult to manipulate the link portions 16 of the unlocking arms 14. The description of the outer housing 10 completes here.

Next, the inner housing 20 will be described. The inner housing 20 which is made of a resin is generally shaped like a cuboid extending in the front-rear direction. As shown in FIGS. 1 and 3B, plural (in this example, three) terminal housing holes 21 penetrate through the inner housing 20 in the front-rear direction so as to be arranged in the width direction.

Female terminals T1 are housed in the respective terminal housing holes 21. Front end openings of the terminal housing holes 21 function as insertion holes 22 into which respective male terminals T2 (see FIGS. 5A and 5B, for example) which are provided in the housing 60 of the male connector 2 are to be inserted. In a state that the female terminals T1 are housed in the respective terminal housing holes 21, lances 23 which are provided in the respective terminal housing holes 21 are engaged with step portions of the female terminals T1, respectively, whereby the female terminals T1 are prevented from coming off. Core wire swaging pieces T1*a* of the female terminals T1 are swaged on conductor core wires E which are exposed from terminals of electric wires W, respectively, and rubber plug swaging pieces T1*b* are swaged on water stop rubber plugs 80 which are provided in the vicinities of the terminals of the electric wires W, respectively. The rubber plugs 80 are press-fitted in rear-end opening portions of the terminal housing holes 21, respectively, and thereby perform a function of sealing the rear-end opening portions watertightly.

As shown in FIGS. 1 and 3A, approximately central portions, in the front-rear direction, of a top wall and a bottom wall of the inner housing 20 are formed with, in a unitized manner, front support portions 24 for supporting front end portions of the elastic members 30 at the centers in the width direction, respectively. In a state that the inner housing 20 is housed in the outer housing 10, the pair of front support portions 24 are opposed to the pair of rear support portions 11 of the outer housing 10 in the front-rear direction, respectively (see FIG. 3A).

As shown in FIGS. 1 and 3B, the outer surfaces of rear portions of two side walls of the inner housing 20 are formed with, in a unitized manner, a pair of lock projections 25 which project outward in the width direction, respectively. The pair of lock projections 25 are formed so as to be engaged with the pair of lock pieces 17 of the outer housing 10, respectively (see FIG. 3B).

As shown in FIGS. 1 and 3B, a flange portion 26 which projects outward over the entire circumference of the inner housing 20 is unitized with the pair of front support portions 24 located in the rear of the flange portion 26. The flange portion 26 has a function of locking the packing 40 (see FIG. 3B).

As shown in FIG. 1, a front end portion of the inner housing 20 (corresponding to front end portions of the terminal housing holes 21) is formed with a pair of slits 27 which extend in the top-bottom direction and are recessed rearward. Step portions 28 are formed in the rear of the respective slits 27 (see FIG. 3B). The pair of slits 27 house parts of a pair of slit insertion portions 52 (see FIG. 1) of the packing holder 50, respectively, and the pair of step portions 28 have a function of engaging with a pair of lock projections 53 (see FIG. 1) of the packing holder 50, respectively. The description of the inner housing 20 completes here.

Next, the elastic members 30 will be described. As described above, the elastic members 30 which are provided in the outer housing 10 have a function of urging the inner housing 20 forward. In this example, each elastic member 30 is a metal coil spring extending straightly and two elastic members 30 are used for the one female connector 1. The description of the elastic members 30 completes here.

Next, the packing 40 will be described. As described above, the packing 40 which is made of a rubber which is placed on the outer circumferential surface of the inner housing 20 and has a function of sealing it watertightly. The packing 40 is approximately shaped like a rectangular ring so as to conform to the outer circumferential shape of the inner housing 20. The packing 40 is attached to the outer circumferential surface of the inner housing 20 from the front side of it and, as shown in FIGS. 3A and 3B, locked on the front end surface of the flange portion 26. The description of the packing 40 completes here.

Next, the packing holder 50 will be described. The packing holder 50 which is made of a resin has a function of holding the packing 40 on the inner housing 20. The packing holder 50 is composed of an approximately rectangular-ring-shaped frame portion 51 which conforms to the outer circumferential shape of the packing 40 and a pair of slit insertion portions 52 which are unitized with the frame portion 51, traverse it in the top-bottom direction, and project forward from prescribed positions of the frame portion 51. Each slit insertion portion 52 is formed with a lock projection 53 (see FIG. 1) which projects inward in the width direction.

The packing holder 50 is attached to the outer circumferential surface of the inner housing 20 from the front side of it so that as shown in FIG. 3 the pair of slit insertion portions 52 are inserted into and housed in the pair of slits 27, respectively, and the frame portion 51 is located in front of and in the vicinity of the packing 40. In a state that the packing holder 50 is attached to the inner housing 20, the pair of lock projections 53 are engaged with the pair of step portion 28, respectively. As a result, the packing holder 50 is prevented from coming off the inner housing 20 and hence the packing 40 is prevented from coming off the inner housing 20. The description of the packing holder 50 completes here.

To house, in the outer housing 10, the inner holder 20 to which the packing 40 and the packing holder 50 are attached, first, the front end portions of the two elastic members 30 are attached to the pair of front support portions 24 of the inner housing 20, respectively. Then the inner housing 20 is inserted into the outer housing 10 through its front opening. In a process that the inner housing 20 is inserted into the outer housing 10, after contact of the pair of lock projections 25 to the pair of lock pieces 17, the pair of lock pieces 17 are deformed elastically outward in the width direction being pushed by the pair of lock projections 25. The pair of lock pieces 17 thereafter recover elastically after the pair of lock projections 25 have passed them. As a result, the pair of lock projections 25 are engaged with the pair of lock pieces 17 (see FIG. 3B) and the inner housing 20 is prevented from coming off.

In a state that the pair of lock projections 25 are engaged with the pair of lock pieces 17 (see FIG. 3B), as shown in FIG. 3A each of the two elastic members 30 is held in the front-rear direction between the associated front support portion 24 and rear support portion 11. In this state, the elastic members 30 may either be shortened (urging forces are generated) or not be shortened (urging forces are not generated) in the compressing direction.

If in this state the inner housing 20 is pushed rearward toward the outer housing 10, the inner housing 20 is moved rearward relative to the outer housing 10 against the urging forces of the elastic members 30. If the pressing of the inner housing 20 is stopped, the inner housing 20 is moved forward relative to the outer housing 10 by the urging forces of the elastic members 30 and returned to the position (the initial position shown in FIG. 3B) where the pair of lock projections 25 are engaged with the pair of lock pieces 17. The assembled female connector 1 shown in FIG. 2 is obtained in the above-described manner.

Next, the male connector 2 will be described briefly with reference to FIGS. 4 and 5A-5C. The male connector 2 is equipped with a resin housing 60. A front portion of the housing 60 is a rectangular-cylinder-shaped hollow portion 61. Tip portions (tab portions) of male terminals T2 (see FIGS. 5A and 5B) which are held in respective terminal housing holes (not shown) formed in a rear portion of the housing 60 are exposed in the internal space of the hollow portion 61. The hollow portion 61 has a function of protecting the tip portions of the male terminals T2. The outer side surfaces of the two side walls of the hollow portion 61 are formed with, in a unitized manner, a pair of lock beaks 62 (see FIGS. 5B and 5C) which project outward in the width direction, respectively.

The housing 60 of the male connector 2 is formed so as to be fitted into the inner housing 20 of the female connector 1. To fit the male connector 2 into the inner housing 20, after the front surfaces of the housings 60 and the outer housing 10 are opposed to each other, the housings 60 and the outer housing 10 are brought closer to each other in the fitting direction so that the hollow portion 61 is inserted in the outer housing 10 and set outside the inner housing 20.

As a result, the inner housing 20 and the housing 60 come closer to each other in the fitting direction. Once the inner housing 20 and the housing 60 are fitted in or with each other (i.e., a state is established that their relative movement has been finished and they move together), the inner housing 20 is moved rearward relative to the outer housing 10 from the initial position against the urging forces of the elastic members 30.

Figure 4:
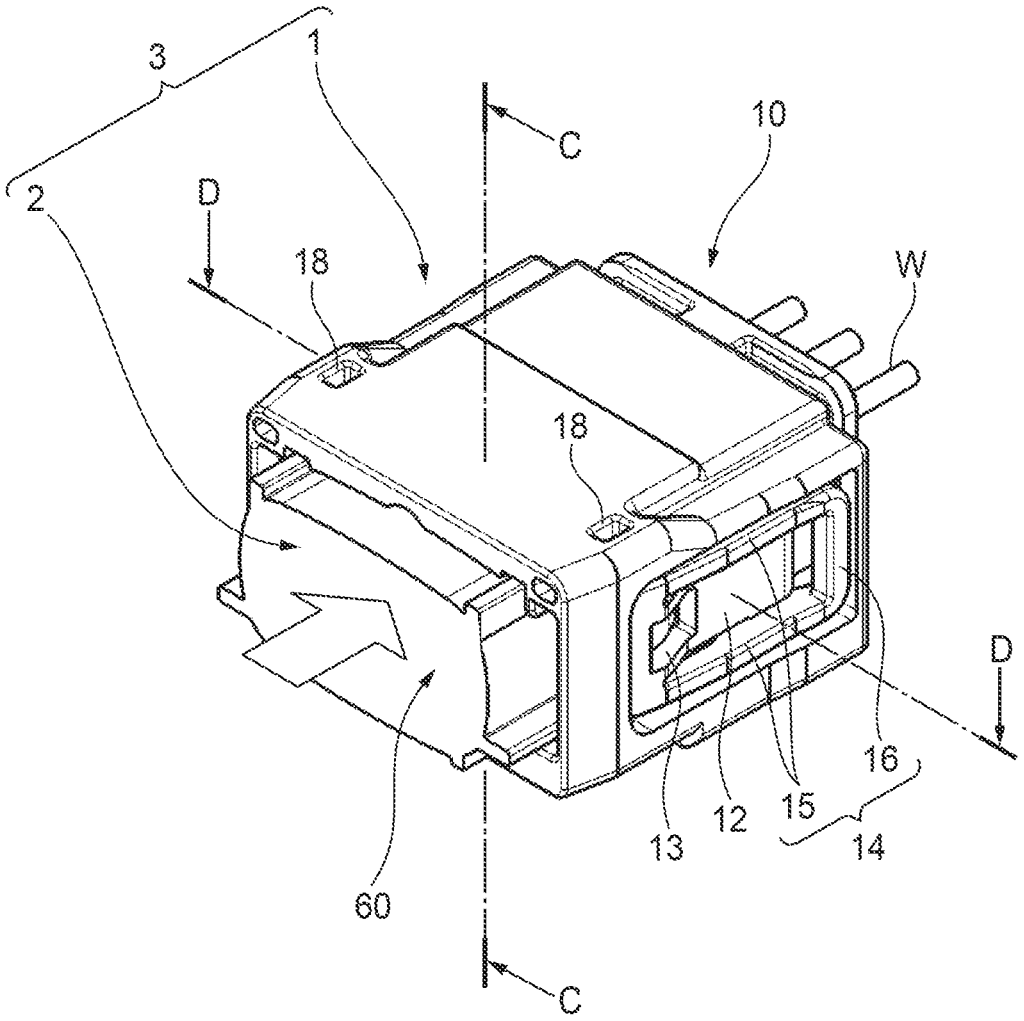
FIG. 4 is a perspective view of a connector structure in which a male connector is fitted in the female connector.

After the stage that the pair of lock beaks 62 of the hollow portion 61 have come into contact with the front end portions of the pair of lock arms 12 of the outer housing 10, the pair of lock arms 12 are deformed elastically outward in the width direction being pushed by the pair of lock beaks 62, respectively. Upon the pair of lock beak 62 reach the pair of lock holes 13 of the pair of lock arms 12, the pair of lock arms 12 recover elastically while the pair of lock beak 62 go into the pair of lock holes 13, respectively. As a result, the pair of lock beaks 62 are engaged with the pair of lock holes 13, respectively (see FIGS. 5B and 5C). The housing 60 and the outer housing 10 are prevented from separating from each other and the housing 60 and the inner housing 20 are kept fitted in or with each other. The connector structure 3 is obtained in which the female connector 1 and the male connector 2 shown in FIG. 4 are fitted with or in each other.

Figure 5A:
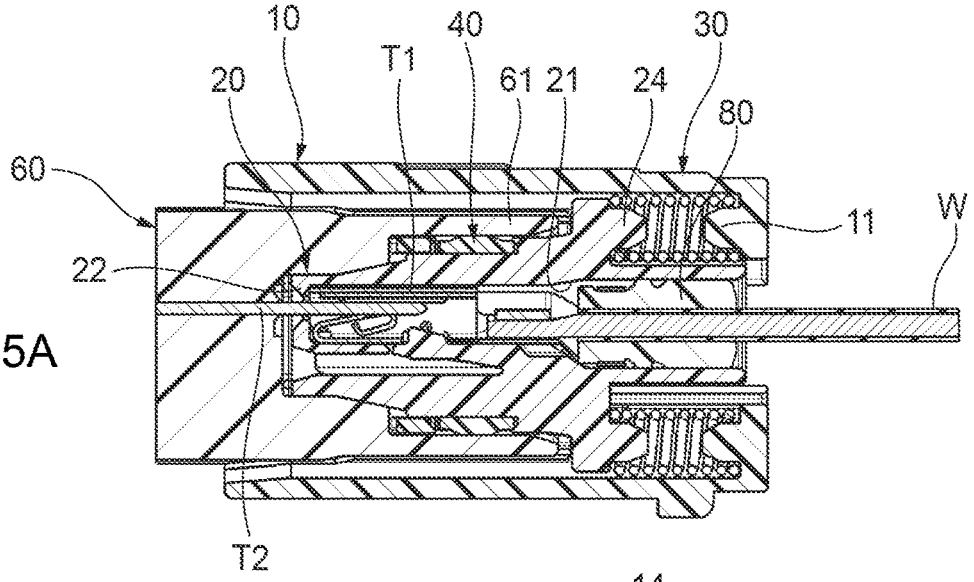
FIG. 5A is a sectional view taken along line C-C in FIG. 4.
Figure 5B:
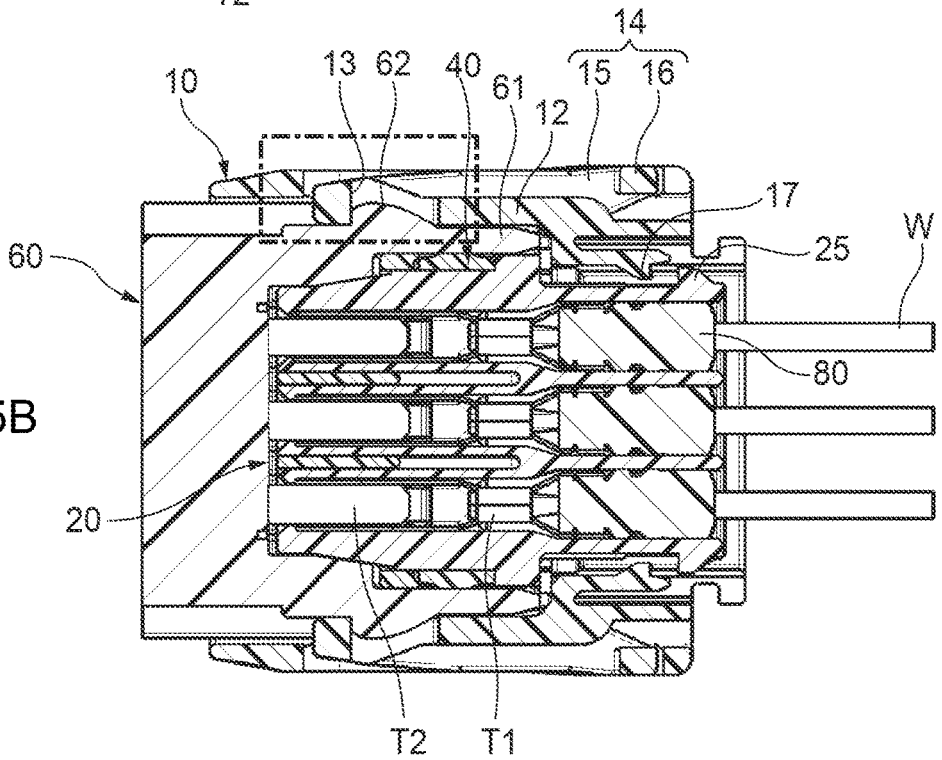
FIG. 5B is a sectional view taken along line D-D in FIG. 4.
Figure 5C:
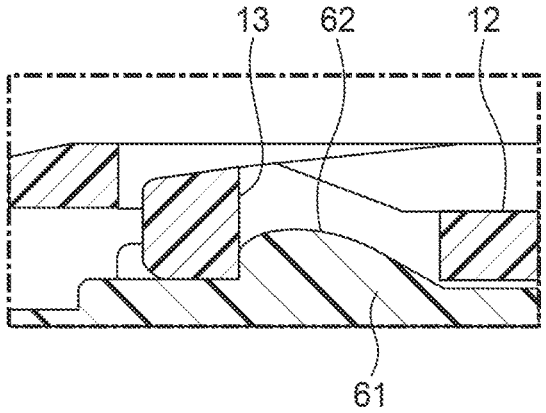
FIG. 5C is an enlarged view of part of FIG. 5B, that is, a lock arm and its neighborhood.

In a state that the housing 60 and the inner housing 20 are fitted in or with each other, the female terminals T1 housed in the inner housing 20 are fitted with and electrically connected to the male terminals T2 housed in the housing 60. Furthermore, as shown in FIGS. 5A and 5B, the packing 40 is held in the radial direction between the inner housing 20 and the hollow portion 61 of the housing 60. As a result, the probability of entrance of water from the outside through the fitting portion between the inner housing 20 and the housing 60 can be made as low as possible.

Furthermore, in the state shown in FIG. 5B, the inner housing 20 is located at the position where it has been moved rearward relative to the outer housing 10 from the initial position and hence the elastic members 30 are shortened in the compressing direction. Thus, the urging forces of the elastic members 30 act as forces in the direction of canceling the fitting between the outer housing 10 and the inner housing 20 and, as a result, act as forces in the direction of canceling the fitting between the outer housing 10 and the housing 60.

Figure 6A:
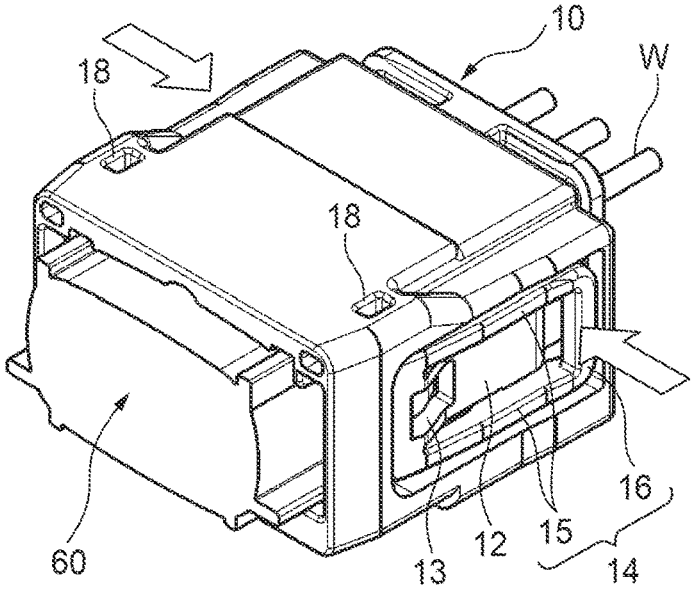
FIG. 6A is a perspective view of the connector structure showing how to manipulate canceling manipulation portions of respective unlocking arms.
Figure 6B:
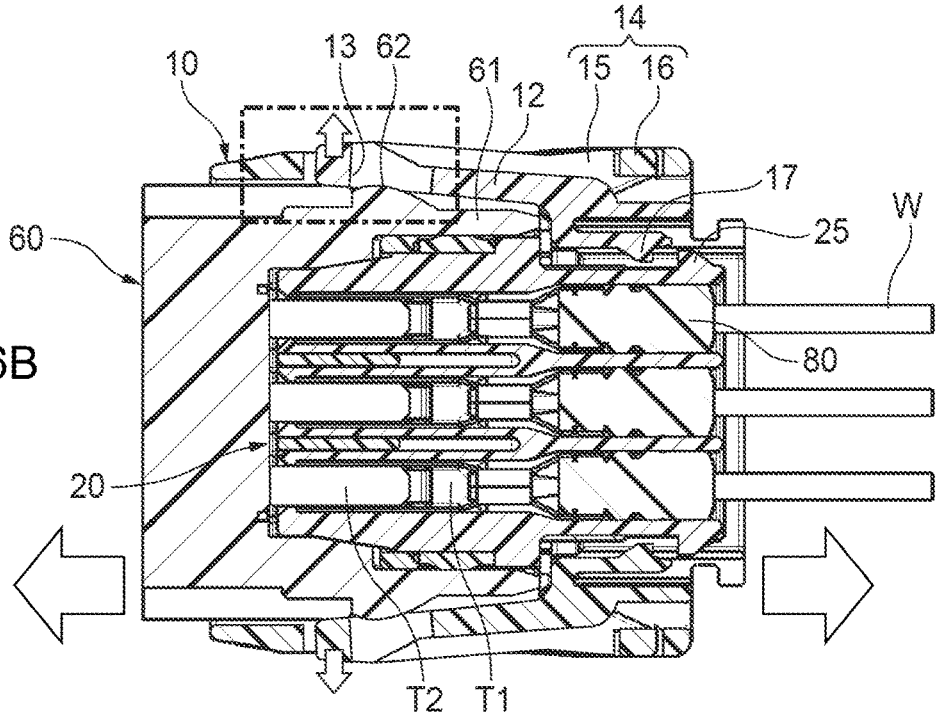
FIG. 6B is a sectional view corresponding to FIG. 5B and shows a state that the canceling manipulation portions of the unlocking arms have been manipulated.
Figure 6C:
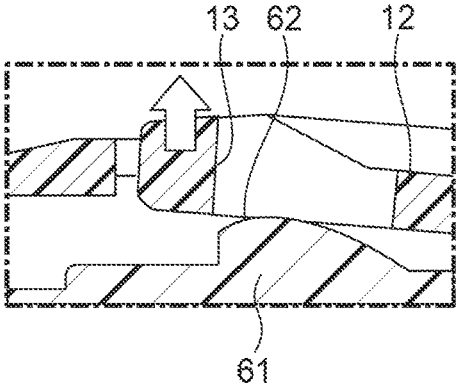
FIG. 6C is an enlarged view of part of FIG. 6B, that is, the lock arm and its neighborhood.

To cancel the fitting state of the housing 60 and the inner housing 20, as shown in FIG. 6A, the link portions 16 of the pair of unlocking arm 14 are pushed inward in the width direction, whereby the lock arms 12 are deformed elastically outward in the width direction (see FIGS. 6A and 6B). As a result, the front end portion (i.e., the portion where the lock hole 13 is formed) of each lock arm 12 is moved outward in the width direction (i.e., in the disengaging direction) and the lock beak 62 is disengaged from the lock hole 13. As soon as the lock beaks 62 are disengaged from the respective lock holes 13, by the urging forces of the elastic member 30, the outer housing 10 and the housing 60 automatically start to move relative to each other in such directions as to cancel their fitting (indicated by arrows in FIG. 6B). For example, where the position of the housing 60 is fixed, only the outer housing 10 is moved so as to go away from the housing 60. For convenience of description, FIG. 6B is drawn as if the outer housing 10 and the housing 60 remained at the positions (i.e., the positions shown in FIG. 5B) where they were located before the lock beaks 62 were disengaged from the respective lock holes 13.

Figure 7A:
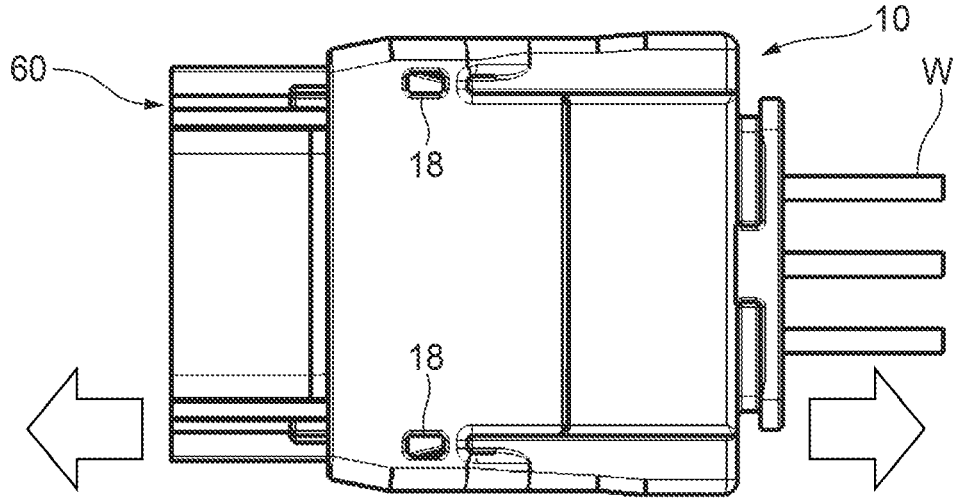
FIG. 7A is a plan view of the connector structure showing how housings are moved relative to each other in fitting canceling directions by urging forces of elastic members at the time of unlocking.
Figure 7B:
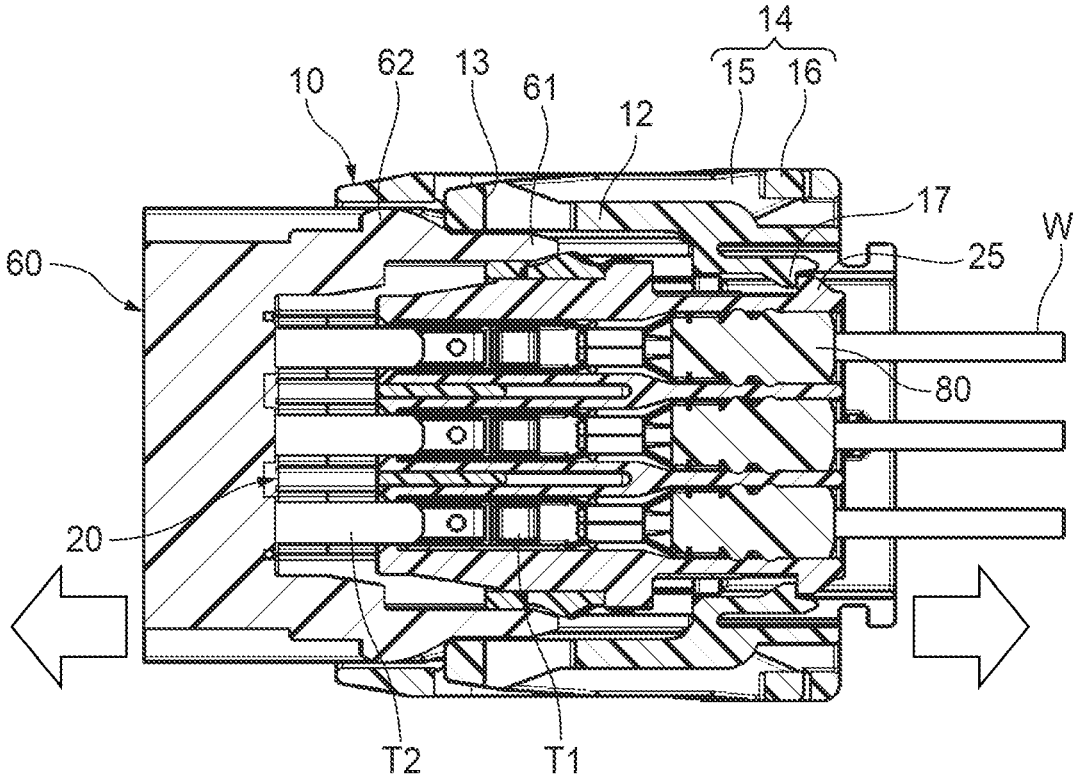
FIG. 7B is a sectional view corresponding to FIG. 5B and shows a state that the housings have been moved relative to each other in the fitting canceling directions by the urging forces of the elastic members.

Subsequently, as shown in FIGS. 7A and 7B, after the outer housing 10 and the housing 60 have been moved relative to each other until the pair of lock projections 25 engage with the pair of lock pieces 17 (i.e., the inner housing 20 is located at the initial position), the connection between the female terminals T1 and the male terminals T2 can be canceled by separating the outer housing 10 and the housing 60 from each other by manual work, for example. As described above, by utilizing the urging forces of the elastic members 30, the external force that is necessary to cancel the fitting between the outer housing 10 and the housing 60 can be made weaker, whereby they can be separated from each other easily.

Incidentally, where another member (e.g., wire harness) exists around the link portions 16 of the pair of unlocking arms 14, there may occur a case that it is difficult to manipulate the link portions 16. In such a case, in the connector structure 3, the outer housing 10 and the housing 60 can be unlocked from each other by inserting a unlocking tool 70 into the pair of penetration holes 18 formed in the outer housing 10 (see FIGS. 8 and 9). This feature will be described below.

As shown in FIG. 8, the unlocking tool 70 is a rod-like member made of a resin or metal and its tip portion is an insertion portion 71 which is narrower than the other portion. The insertion portion 71 is inserted into the penetration holes 18. A tip portion of the insertion portion 71 is formed with a taper surface 72.

As shown in FIG. 9, when the insertion portion 71 of the unlocking tool 70 is inserted down into a penetration hole 18 from above the outer housing 10 with the taper surface 72 located outside in the width direction, the taper surface 72 comes into contact with an inside (in the width direction) top edge of the lock arm 12. If the unlocking tool 70 is inserted downward further from this state, the lock arm 12 is deformed elastically outward in the width direction (i.e., in the disengaging direction) being pushed by the taper surface 72. As a result, the lock beak 62 is disengaged (unlocked)

from the lock hole 13. Although in FIG. 9 this work is performed on one side in the width direction, in actuality this work is performed on both sides in the width direction.

In the connector structure 3 according to the embodiment of the invention, even in the case where it is difficult to manipulate the unlocking arm 14, unlocking can be performed by inserting the unlocking tool 70 into the through-holes 18 which are formed at positions different than the unlocking arms 14 are located. As a result, the outer housing 10 and the housing 60 can be separated from each other easily utilizing the urging forces of the elastic members 30. This makes it possible to cancel the fitting state of the inner housing 20 and the housing 60.

Other Embodiments

In addition, the invention is not limited to the aforementioned embodiments, but various modifications can be used within the scope of the invention. For example, the invention is not limited to the aforementioned embodiments, but changes, improvements, etc. can be made on the invention suitably. In addition, materials, shapes, dimensions, numbers, arrangement places, etc. of respective constituent elements in the aforementioned embodiments are not limited. Any materials, any shapes, any dimensions, any numbers, any arrangement places, etc. may be used as long as the invention can be attained.

For example, in the embodiment, the unlocking arms 14 are employed as the "first unlocking mechanism" (a term used in the invention) and the penetration holes 18 which are formed at the positions different than the unlocking arms 14 are located are employed as the "second unlocking mechanism" (a term used in the invention). Alternatively, unlocking arms having the same structure as the unlocking arms 14 and located at different positions than the unlocking arms 14 may be used as the "second unlocking mechanism." That is, another pair of unlocking arms that extend from the tip portions (free end portions) in different directions than the unlocking arms 14, respectively, may be provided in addition to the unlocking arms 14.

The features of the above-described connector structure 3 according to the embodiment of the invention will be summarized concisely below in the form of items [1] and [2]:

[1] A connector structure (3) comprising a first connector (1) and a second connector (2) to be fitted each other, the first connector (1) having: an outer housing (10); an inner housing (20) supported by the outer housing (10) to allow a displacement of the inner housing (20) in a fitting direction; and an elastic member (30) to urge the inner housing (20) forward in the fitting direction, the second connector (2) having a counterpart housing (60) to be attached to the outer housing (10), upon fitting the first connector (1) and the second connector (2), while the elastic member (30) generating a forward urging force in the fitting direction due to the displacement of the inner housing (20) rearward in the fitting direction, the outer housing (10) having: a lock mechanism (12) to be engaged with the counterpart housing (60) to restrict a rearward movement of the counterpart housing (60) in the fitting direction upon fitting the first connector (1) and the second connector (2); a first unlocking mechanism (14) configured to disengage the lock mechanism (12); and a second unlocking mechanism (18) located at a different position than the first unlocking mechanism (14) and configured to disengage the lock mechanism (12) independently of the first unlocking mechanism (14).

[2] The connector structure (3) according to the item [1], wherein the lock mechanism (12) is a lock arm (12) having a cantilevered-shape and an engagement portion (13) to be engaged with a projection portion (62) provided in the counterpart housing (60)

the first unlocking mechanism (14) has a manipulation portion provided as a part of the outer housing (10) to be exposed to outside of the outer housing (10) and configured to bend the lock arm (12) in a direction to disengage the projection portion (62) and the engagement portion (13), the second unlocking mechanism (18) has a penetration portion (16) configured to allow an communication from outside of the outer housing (10) to an engagement location of the projection portion (62) and the engagement portion (13) by inserting a unlocking tool (70) through the penetration portion (16) to move the engagement portion (13) in a direction to disengage the projection portion (62) and the engagement portion (13).

REFERENCE SIGNS LIST

1: Female connector (first connector)
2: Male connector (second connector)
3: Connector structure
10: Outer housing
12: Lock arm (lock mechanism)
13: lock hole (engagement portion)
14: Unlocking arm (first unlocking mechanism)
16: Link portion (manipulation portion)
18: Through-hole (penetration portion, second unlocking mechanism)
20: Inner housing
30: Elastic member
60: Housing (counterpart housing)
62: Lock beak (projection)
70: Unlocking tool
T1: Female terminal (first terminal)
T2: Male terminal (second terminal)

The invention claimed is:

1. A connector structure comprising a first connector and a second connector to be fitted each other, the first connector having: an outer housing; an inner housing supported by the outer housing to allow a displacement of the inner housing in a fitting direction; and an elastic member to urge the inner housing forward in the fitting direction, the second connector having a counterpart housing to be attached to the outer housing, upon fitting the first connector and the second connector, while the elastic member generating a forward urging force in the fitting direction due to the displacement of the inner housing rearward in the fitting direction, the outer housing having: a lock mechanism to be engaged with the counterpart housing to restrict a rearward movement of the counterpart housing in the fitting direction upon fitting the first connector and the second connector; a first unlocking mechanism configured to disengage the lock mechanism; and a second unlocking mechanism located at a different position than the first unlocking mechanism and configured to disengage the lock mechanism independently of the first unlocking mechanism.

2. The connector structure according to claim 1, wherein the lock mechanism is a lock arm having a cantilevered-shape and an engagement portion to be engaged with a projection portion provided in the counterpart housing, the first unlocking mechanism has a manipulation portion provided as a part of the outer housing to be exposed to outside of the outer housing and configured to bend the lock arm in a direction to disengage the projection portion and the engagement portion, the second unlocking mechanism has a penetration portion configured to allow a communication from outside of the outer housing to an engagement location of the projection portion and the engagement portion by inserting an unlocking tool through the penetration portion to move the engagement portion in a direction to disengage the projection portion and the engagement portion.

3. The connector structure according to claim 1, wherein the second unlocking mechanism comprises a hole through a surface of the outer housing and into an interior of the outer housing, wherein the hole comprises a channel that is is extended, in a direction perpendicular to the fitting direction, through the surface of the outer housing and to a side of the first unlocking mechanism facing the interior of the outer housing.

4. The connector structure according to claim 1, wherein the first unlocking mechanism is configured to unlock the lock mechanism from the counterpart housing by action in a first direction opposite to a second direction of action through which the second unlocking mechanism is configured to unlock the lock mechanism from the counterpart housing, wherein the first direction is from an exterior of the counterpart housing to an interior of the counterpart housing, wherein the second direction is from the interior of the counterpart housing to the exterior of the counterpart housing, and wherein the first direction is perpendicular to the fitting direction.

* * * * *